US008733554B2

(12) United States Patent
Sato et al.

(10) Patent No.: US 8,733,554 B2
(45) Date of Patent: May 27, 2014

(54) ABRASIVE GRAINS CLASSIFYING APPARATUS

(75) Inventors: Fumio Sato, Tochigi (JP); Takashi Yoshida, Tochigi (JP); Toshiya Hirata, Tochigi (JP); Koji Saito, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 13 days.

(21) Appl. No.: 12/749,774

(22) Filed: Mar. 30, 2010

(65) Prior Publication Data

US 2010/0243540 A1 Sep. 30, 2010

(30) Foreign Application Priority Data

Mar. 31, 2009 (JP) ..... 2009-085596

(51) Int. Cl.
*B07B 13/00* (2006.01)
*B24B 57/00* (2006.01)
*B07B 1/14* (2006.01)

(52) U.S. Cl.
CPC . *B07B 1/14* (2013.01); *B24B 57/00* (2013.01); *B07B 2201/04* (2013.01)
USPC ..... 209/667

(58) Field of Classification Search
USPC ..... 209/667, 668
See application file for complete search history.

(56) References Cited

U.S. PATENT DOCUMENTS

| | | | | | |
|---|---|---|---|---|---|
| 1,466,015 | A | * | 8/1923 | Hartley et al. | 209/668 |
| 2,960,224 | A | * | 11/1960 | Cronan | 209/668 |
| 3,313,410 | A | * | 4/1967 | Gardner | 209/668 |
| 4,172,527 | A | * | 10/1979 | Bost | 209/668 |
| 5,360,119 | A | * | 11/1994 | Nakamura et al. | 209/618 |
| 6,135,020 | A | * | 10/2000 | Broyles | 99/569 |

FOREIGN PATENT DOCUMENTS

| | | |
|---|---|---|
| DE | 2432179 | 1/1976 |
| FR | 956520 | 2/1950 |
| JP | 62-247873 | 10/1987 |
| JP | 05-7374 U | 2/1993 |
| JP | 2000-153459 | 6/2000 |
| JP | 2004-360041 | 12/2004 |
| JP | 2005-279842 | 10/2005 |
| JP | 2007-98243 | 4/2007 |

* cited by examiner

*Primary Examiner* — Joseph C Rodriguez
(74) *Attorney, Agent, or Firm* — Rankin, Hill & Clark LLP

(57) ABSTRACT

An abrasive grains classifying apparatus is used to classify abrasive grains based on their sizes that can be determined by distances between mutually opposed surfaces of the respective abrasive grains. The abrasive grains classifying apparatus is provided with: a first gap portion 35 which includes two rollers 24 and 32 disposed at a predetermined distance L2 from each other and also which classifies the abrasive grains 60 into first abrasive grains 60*b* and 60*c* capable of passing through between the rollers 24 and 32 and second abrasive grains 60*a* incapable of passing through between the two rollers 24 and 32; and a second gap portion 54 which includes two rollers 54 and 69 disposed at a distance L3 smaller than the distance L2 in the first gap portion 35 from each other.

12 Claims, 9 Drawing Sheets

ABRASIVE GRAINS CLASSIFYING APPARATUS

BACKGROUND OF THE INVENTION

1. Field of the Invention

The present invention relates to an abrasive grains classifying apparatus for classifying abrasive grains based on their sizes.

2. Background Art

Abrasive grains are classified based on their sizes using an abrasive grain classifying apparatus. The classified abrasive grains are attached to a base material to thereby manufacture a grinding stone (see, for example, JP-A-2005-279842 (FIG. 4)).

The prior art grinding stone as disclosed in JP-A-2005-279842 is described with reference to FIGS. 12A and 12B.

As shown in FIG. 12A, abrasive grains 202 are attached to an upper surface of a base material 201 through a plated layer 203.

As shown in FIG. 12B, leading ends of the abrasive grains 202 are cut to align heights of the abrasive grains 202, thereby manufacturing a grinding stone 205.

The inventors of the present invention have checked abrasive grains on the market for variations in their sizes. The check result has found that a grain diameter (for example, 200 μm) of an abrasive grain having the greatest grain diameter is two times or more than a grain diameter (for example, 50 μm) of an abrasive grain having the smallest grain diameter.

In order to align the heights of the abrasive grains, it is necessary to adjust the heights of the abrasive grains to the height of the abrasive grain having the smallest grain diameter. Therefore, in some cases, for the height adjustment, the abrasive grain having the largest grain diameter is cut by half or more.

That is, since projecting quantities of the abrasive grains from the base material are different from each other, there are inevitably generated the abrasive grains that are cut greatly, which results in waste cutting. If, in an abrasive grains classifying operation, the abrasive grains can be classified precisely, such waste can be avoided.

It is desired to provide an abrasive grains classifying apparatus which can manage sizes of the abrasive grains with high precision.

SUMMARY OF THE INVENTION

One or more embodiments of the present invention provide an abrasive grains classifying apparatus which can manage sizes of abrasive grains with high precision.

In accordance with one or more embodiments of the present invention, in an abrasive grains classifying apparatus 10 for classifying abrasive grains 60 based on sizes of the abrasive grains 60, each of the abrasive grains 60 having polyhedral shape in which mutually opposed surfaces are parallel to each other, and the size of the each of the abrasive grains 60 being determined by distances L4 between said mutually opposed surfaces, the abrasive grains classifying apparatus 10 is provided with: a first gap portion 35, 68, 16 including two first rigid bodies 24, 32, 66, 65 disposed at a first predetermined distance L2 from each other and configured to supply the abrasive grains 60 between the two first rigid bodies and classify the abrasive grains 60 into first abrasive grains 60*b*, 60*c*, 60*d*, 60*e*, 60*f*, 60*g* capable of passing between the two first rigid bodies 24, 32, 66, 65 and second abrasive grains 60*a* incapable of passing between the two first rigid bodies 24, 32, 66, 65; and a second gap portion 54, 69, 17 including two second rigid bodies 48, 49, 67, 65 disposed at a second predetermined distance L3 smaller than said first predetermined distance L2 from each other and configured to supply said first abrasive grains 60*b*, 60*c*, 60*d*, 60*e*, 60*f*, 60*g* having passed through said first gap portion 35, 68, 16 between the two second rigid bodies 48, 49, 67, 65 and classify said first abrasive grains 60*b*, 60*c*, 60*d*, 60*e*, 60*f*, 60*g* into third abrasive grains 60*c* capable of passing between the two second rigid bodies 48, 49, 67, 65 and fourth abrasive grains 60*b*, 60*d*, 60*e*, 60*f*, 60*g* incapable of passing between the two second rigid bodies 48, 49, 67, 65.

According to the above structure, the apparatus includes the first gap portion and the second gap portion narrower than the first gap portion, and the abrasive grains are fed sequentially in the order of the first and second gap portions. Abrasive grains larger in size than the gaps are incapable of passing through the gaps portion. Abrasive grains smaller in size than the gaps are capable of passing through the gap portions. Abrasive grains, which have passed through the first gap but have not passed through the second gap, can be said that their sizes are within a predetermined range. Each gap portion can be formed by providing a gap between two rigid bodies, and the distance between the two rigid bodies can be adjusted with high precision. This makes it possible to manage the sizes of the abrasive grains with high precision.

Also, the abrasive grains are fed to the gap between the rigid bodies to thereby classify them. When the smallest height portions of the abrasive grains are shorter than the gap, the abrasive grains are allowed to pass through the gap portion. Owing to this, the classification of the abrasive grains can be managed using the smallest height portions of the abrasive grains. When such abrasive grains are used to produce a grinding stone, by arranging the heights of the abrasive grains at the smallest height portions of the abrasive grains, the projecting quantities of the abrasive grains can be arranged. This makes it possible to reduce the cutting quantities of the abrasive grains.

In the above structure, the two first rigid bodies 24, 32 may comprise first rollers 24, 32, and the two second rigid bodies 48, 49 may comprise second rollers 48, 49. In addition, each roller 24, 32, 48, 49 may be formed such that it has a circular section shape. According to this structure, when the distance between the axes of the rollers is adjusted, the gap of the gap portion can be managed. This can facilitate the management of the gap.

In the above structure, the first rollers 24, 32 may be configured to be rotated by a first actuator 22, and the second rollers 48, 49 may be configured to be rotated by a second actuator 46. According to this structure, when the rollers are rotated, the abrasive grains are also rotated. Since the abrasive grains are rotated, abrasive grains, the smallest heights of which are smaller than the gap portion, are allowed to pass more positively. This can increase the precision of the classification.

In the above structure, the first and second rollers 24, 32, 44, 49 may respectively be inclined with respect to a horizontal axis 61. Owing to this, abrasive grains not having passed through the gap portion are allowed to move on the roller under their own weights. Since the abrasive grains are not allowed to stay at one place, next abrasive grains can be fed in, thereby being able to carry out the classifying operation smoothly.

In the above structure, the first rollers 24, 32 may be configured to be rotated by the first actuator 22 toward a direction for raising the abrasive grains 60, and the second rollers 48, 49 may be configured to be rotated by the second actuator 46 toward a direction for raising the abrasive grains 60*b*, 60*c*.

That is, when the first rollers 24, 32 are viewed in an axial direction of the first rollers 24, 32, a left side roller 24, 32 of the first rollers 24, 32 may be configured to rotate in a counterclockwise direction and a right side roller 24, 32 of the first rollers 24, 32 may be configured to rotate in a clockwise direction. When the second rollers 48, 49 are viewed in an axial direction of the second rollers 48, 49, a left side roller 48, 49 of the second rollers 48, 49 may be configured to rotate in a counterclockwise direction and a right side roller 48, 49 of the second rollers 48, 49 may be configured to rotate in a clockwise direction. This can prevent the abrasive grains from biting into the rollers and thus can carry out the classifying operation smoothly.

Other aspects and advantages of the invention will be apparent from the following description, the drawings and the claims.

DETAILED DESCRIPTION OF THE EXEMPLARY EMBODIMENTS

Exemplary embodiments of the invention are described with reference to the accompanying drawings.

Figure 1:
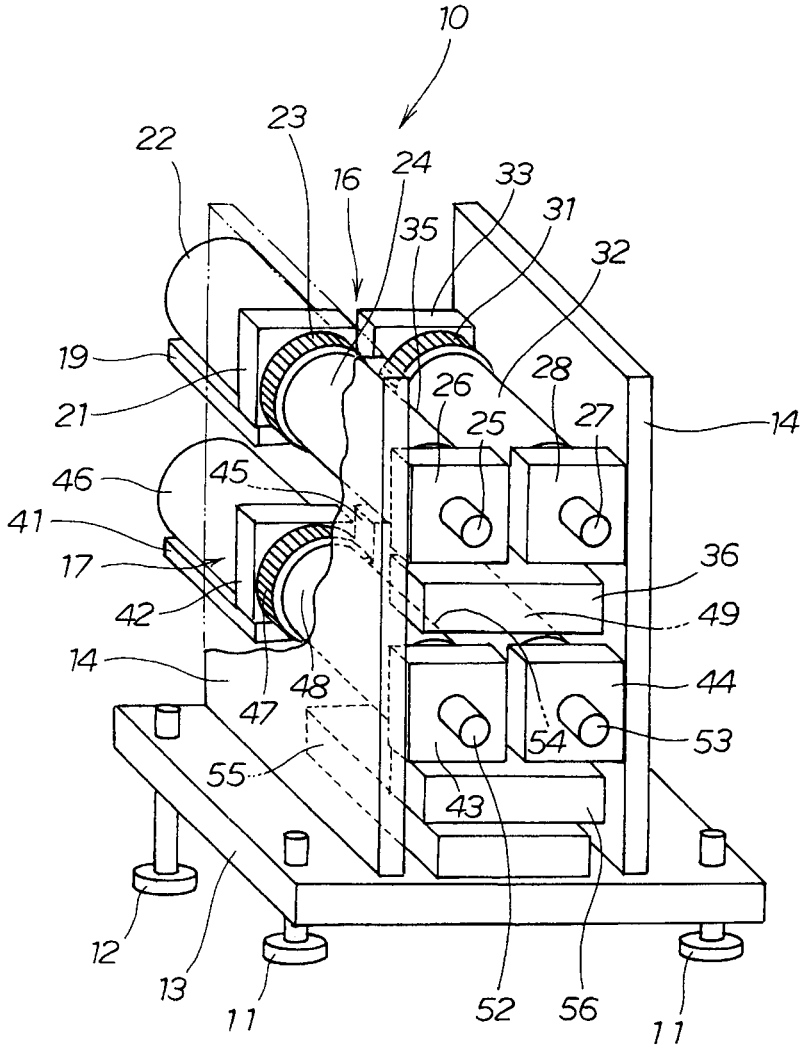
FIG. 1 is a perspective view of an abrasive grains classifying apparatus according to an exemplary embodiment of the invention.

As shown in FIG. 1, an abrasive grains classifying apparatus 10 of an exemplary embodiment of the invention includes front leg portions 11, 11, rear leg portions 12 (the rear leg portion disposed on the deep side is not shown) respectively longer than the front leg portions 11, 11, a base member 13 supported on the different-length leg portions 11, 12 and formed obliquely with respect to the horizontal axis, vertical walls 14, 14 respectively supported on the base member 13, a first classifying mechanism 16 supported on the upper portions of the vertical walls 14 for selecting abrasive grains, and a second classifying mechanism 17 disposed downwardly of the first classifying mechanism 16 for further selecting the abrasive grains that have passed through the first classifying mechanism 16.

The first classifying mechanism 16 includes a bearing block 21 which is supported on the left vertical wall 14 and on the lower surface of which a flange 19 is to be disposed; a first actuator 22 the shaft of which is supported on the bearing block 21 and the main body of which is supported on the flange 19; a first roller 24 serving as a rigid body which can be rotated by the first actuator 22 and on the end portion of which there is disposed a drive gear 23; a bearing block 26 for supporting the leading end shaft 25 of the first roller 24 rotatably; a bearing block 28 for rotatably supporting a shaft 27 disposed spaced a predetermined distance from the shaft 25 supported on the bearing block 26; a first roller 32 on which there is disposed a driven gear 31 in contact with the drive gear 23 and also which, when the first actuator 22 is operated, can be rotated together with the driven gear 31; a bearing block 33 for supporting the first roller 32; a first gap portion 35 which is formed between the first rollers 24 and 32, and also to the upper surface of which there are fed abrasive grains; and, an abrasive grains take-out box 36 which is disposed downstream downwardly of the first rollers 24, 32 and to which there are fed the abrasive grains that have not passed through the first gap portion 35.

Description will be given later of the abrasive grains that have passed through the first gap portion 35.

The second classifying mechanism 17 is basically similar in structure to the first classifying mechanism 16 and thus can be operated similarly.

That is, the second classifying mechanism 17 includes: a flange 41; bearing blocks 42, 43, 44 and 45; a second actuator 46; a drive gear 47; second rollers 48 and 49; shafts 52 and 53; a driven gear; a second gap portion 54; and, an abrasive grains take-out box 56.

The second gap portion 54 is structured such that its gap is narrower than the first gap portion 35. Also, downwardly of the second rollers 48 and 49, there is disposed an abrasive grains take-out box 55 into which the abrasive grains having passed through the second gap portion 54 are allowed to drop down.

Description will be given below of the flow of the abrasive grains with reference to FIG. 2.

Figure 2:
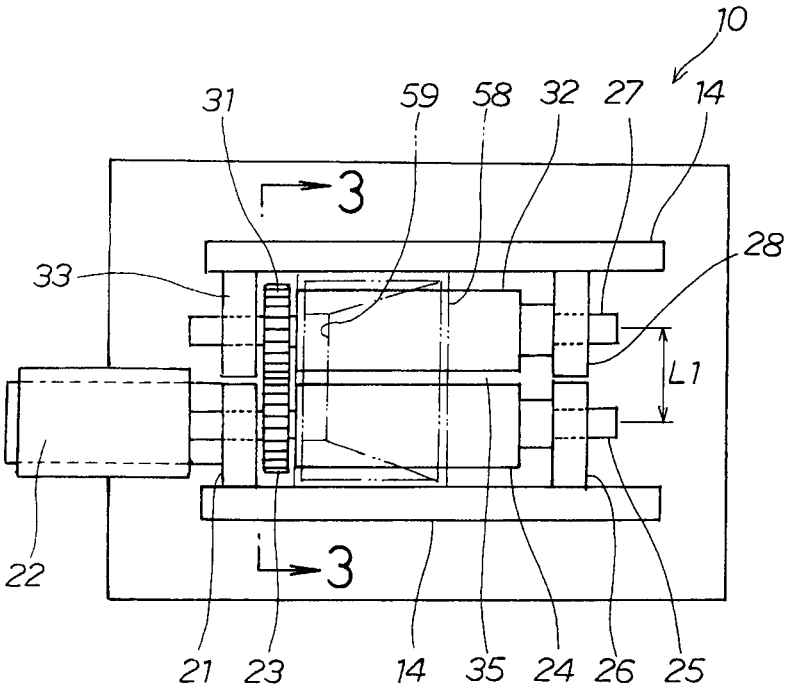
FIG. 2 is a plan view of the abrasive grains classifying apparatus.

As shown in FIG. 2, the abrasive grains are fed to a hopper 58 shown by an imaginary line, and the abrasive grains are then fed from the abrasive grain feed port 59 of the hopper 58 toward the first gap portion 35. The abrasive grain feed port 59, preferably, may be disposed upstream of the first gap portion 35. Due to this, the abrasive grains are allowed to pass from upstream (in FIG. 2, the left side) of the first gap portion 35 to downstream (in FIG. 2, the right side) thereof. Since the abrasive grains classification is carried out depending on whether the abrasive grains can pass through the first gap portion 35 or not, the longer the passing distance of the abrasive grains is, the more accurate the classification is.

When the first actuator 22 is driven, the shaft 25 is rotated. With the rotation of the shaft 25, there are also rotated the first roller 24 and drive gear 23 which are respectively disposed on the shaft 25. With the rotation of the drive gear 23, there is also rotated the driven gear 31. When the driven gear 31 is rotated, there is also rotated the shaft 27 that is inserted through the driven gear 31, thereby rotating the first roller 32 as well that is disposed on the shaft 27.

On the other hand, the bearing blocks 21, 26, 28 and 33 respectively support the shafts 25 and 27 while rotating them; and, the bearing blocks 21, 26, 28 and 33 are fixed to the vertical wall 14 and are themselves unmovable.

After the first actuator 22 is operated, the abrasive grains are fed from the hopper 58.

The gap of the first gap portion 35 can be managed by adjusting the distance L between the shafts 25 and 27. The first rollers 24 and 32 are respectively formed to have a circular section shape. By controlling the distance between the shafts 25 and 27 of the first rollers 24 and 32, the gap of the first gap portion 35 can be managed. That is, the gap management can be carried out easily.

A driving mechanism of the abrasive grains classifying apparatus is described with reference to FIG. 3.

Figure 3:
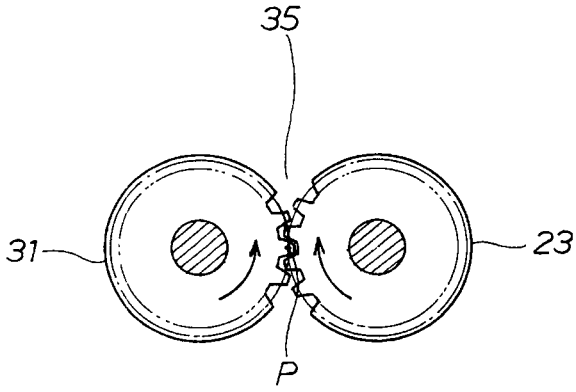
FIG. 3 is a view taken along an arrow line 3-3 shown in FIG. 2.

As shown in FIG. 3, when the drive gear 23 is driven clockwise, the driven gear 31 is driven counterclockwise. Upwardly of a contact point P where these gears 23 and 31 are contacted with each other, there is disposed the first gap portion 35. Therefore, when a force is applied to abrasive grains being fed to the first gap portion 35 in a direction where the abrasive grains are raised up, the abrasive grains are rotated. This can prevent the abrasive grains from biting into between rollers and thus can realize a smooth classifying operation.

An operation of the abrasive grains classifying apparatus is described with reference to FIG. 4.

Figure 4:
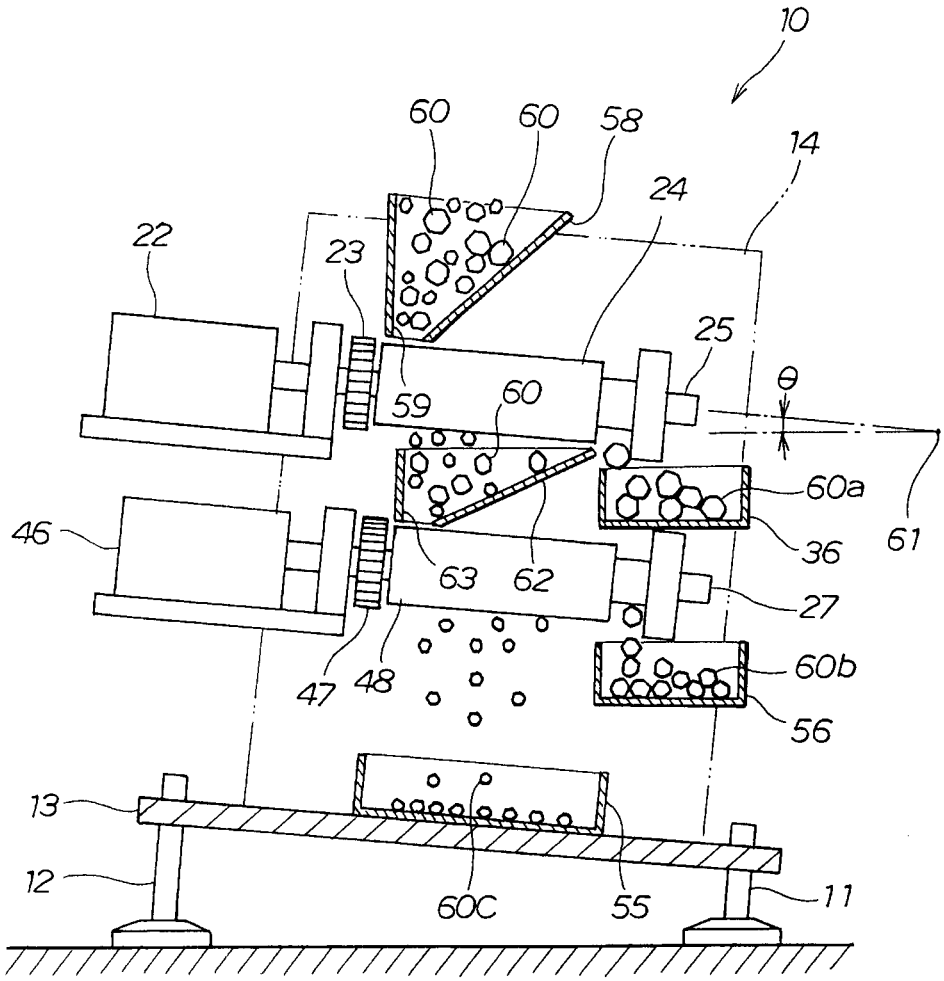
FIG. 4 is an explanatory view of an operation of the abrasive grains classifying apparatus.

As shown in FIG. 4, the abrasive grains 60 are thrown into the hopper 58. The thrown abrasive grains are firstly fed to the upper surface of the first roller 24. In this case, the first roller 24 is disposed such that it is inclined with respect to a horizontal axis 61 (for example, at an angle of inclination of 10°). Owing to this, the abrasive grains 60 are allowed to roll and move under the weight of itself. Abrasive grains 60*a* (a character "a" is a subscript which means the abrasive grains that have not passed through the first roller 24), which are unable to pass through the first roller 24, are allowed to drop down into the abrasive grains take-out box 36.

The abrasive grains 60 having passed through the gap of the first roller 24 are allowed to drop down into a hopper 62 which is disposed downwardly of the first roller 24. The abrasive grains feed port 63 of the hopper 62, similarly to the hopper 58 which is disposed upwardly of the first roller 24, is disposed upstream upwardly of the second roller 48.

The abrasive grains 60 having dropped down into the hopper 62 are fed to the upper surface of the second roller 48. Abrasive grains 60*b* (a character "b" is a subscript which means the abrasive grains that have not passed through the second roller 48. This applies similarly hereinafter.), which are unable to pass through the second roller 48, are allowed to drop down into the abrasive grains take-out box 56.

The abrasive grains 60*c*, (a character "c" is a subscript which means the abrasive grains that have passed through the second roller 48. This applies similarly hereinafter.), which have passed through the gap of the second roller 24, are allowed to drop down into the abrasive grains take-out box 55.

The rollers 24 and 48 are respectively disposed inclined with respect to the horizontal axis 61. Owing to this, the abrasive grains 60 not having passed through the gap portions 35 and 54 are allowed to move on the rollers 24 and 48 due to their own weights. Since the abrasive grains are not allowed to stay in one portion, the next abrasive grains 60 can be fed and thus the classifying operation can be carried out smoothly.

Next, the classifying operation is described with reference to FIGS. 5A to 5C.

Figure 5A:
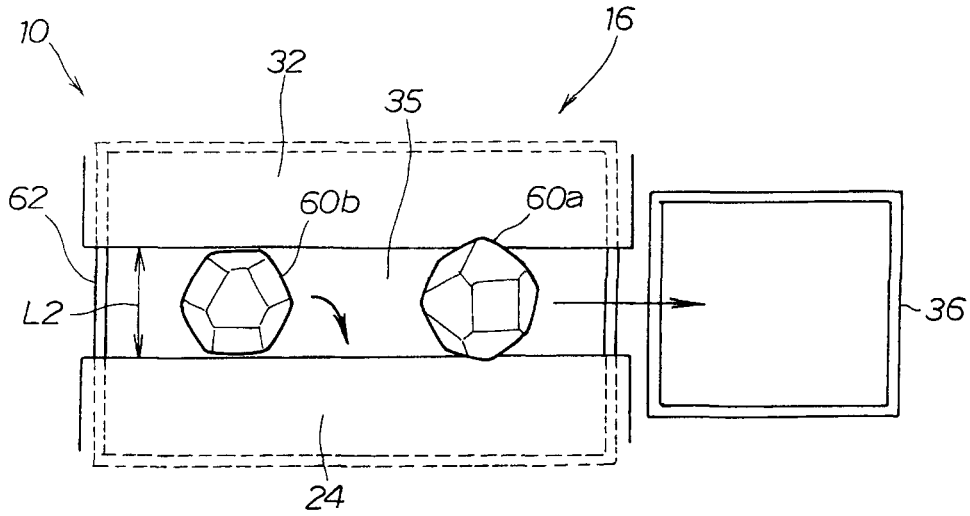
FIG. 5A is an explanatory view of an operation of a first gap portion.

As shown in FIG. 5A, the width of the first gap portion 35 is set, for example, for L2 (L2=475 μm). Abrasive grains 60*a* larger in size than this width are allowed to roll on the first rollers 24 and 32 and drop down into the abrasive grains take-out box 36.

On the other hand, abrasive grains 60*b*, 60*c* smaller in size than this width (L2) are allowed to drop down from the first gap portion 35 into the hopper 62.

Figure 5B:
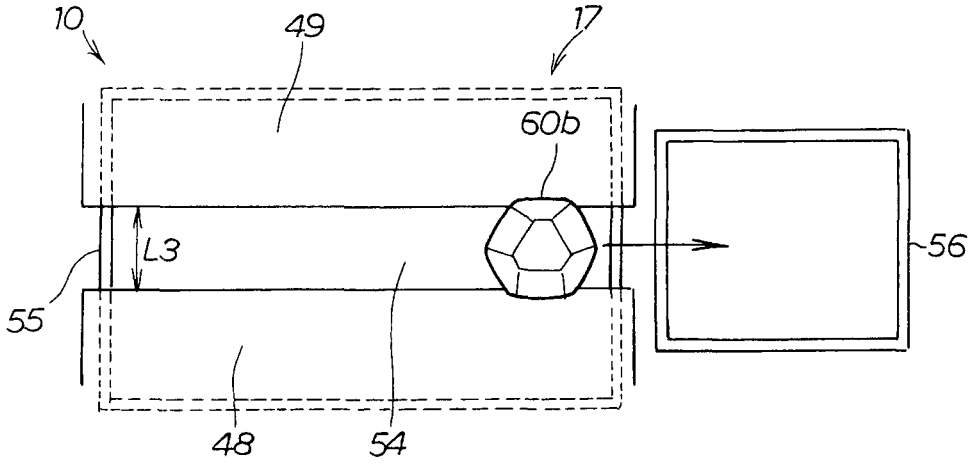
FIG. 5B is an explanatory view of an operation of a second gap portion.

The abrasive grains 60*b*, 60*c* having dropped down into the hopper 62, as shown in FIG. 5B, are fed to the second rollers 48 and 49. The width of the second gap portion 54 formed in the gap between the second rollers 48 and 49 is set, for example, for L3 (L3=465 μm). Abrasive grains 60*b* larger in size than this width (L3) are allowed to roll on the second rollers 48 and 49 and drop down into the abrasive grain take-out box 56.

As can be understood from FIGS. 5A and 5B, the abrasive grains 60*b* are abrasive grains which are smaller than the predetermined size (width) L2 and are larger than the predetermined size (width) L3.

Thus, the classifying operation is carried out in the following manner. Specifically, since there are formed gaps respectively between the rollers 24 and 32, as well as between the rollers 48 and 49, there are formed the first gap portion 35 and second gap portion 54 respectively, and the abrasive grains 60 are then fed to these gap portions 35 and 54. The abrasive grains 60 larger in size than the gaps are not allowed to pass through the gap portions 35 and 54, while the abrasive grains 60 smaller in size than the gaps are allowed to pass through the gap portions 35 and 54. The abrasive grains 60*b*, which have passed through the first gap portion 35 but have not passed through the second gap portion 54, can be said that their sizes are within a predetermined range. The gap portions 35 and 54 are formed respectively by providing gaps between the rollers 24 and 32 as well as between 48 and 49, and the gaps between the rollers 24, 32 and 48, 49 can be adjusted with high precision. Owing to this, the sizes of the abrasive grains can be managed with high precision.

Figure 5C:
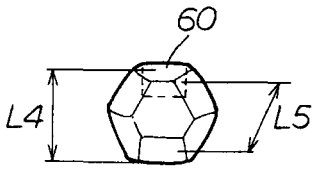
FIG. 5C is an explanatory view of an abrasive grain.

As shown in FIG. 5C, in an abrasive grain 60 having, for example, a truncated octahedron shape, the face-to-face distance L4 between two mutually opposed hexagonal surfaces is different from the face-to-face distance L5 between two mutually opposed quadrangle surfaces.

Let us assume here that L4 is shorter than L5. When L4 is shorter than L2 shown in FIG. 5A and is longer than L3 shown in FIG. 5B, the abrasive grain 60 is fed to the abrasive grains take-out box 56.

That is, the abrasive grains 60 are classified according to their sizes that can be determined by the distances between mutually opposed surfaces.

The classifying operation shown in FIGS. 5A and 5B can be described in the following manner.

That is, the abrasive grains are classified by passing them through the gaps formed respectively between the rollers 24 and 32 as well as between 48 and 49. When the smallest height portions of the abrasive grains 60 are shorter than the gaps, the abrasive grains 60 are allowed to pass through the gap portions 35 and 54. Thus, the classification of the abrasive grains 60 can be controlled using the minimum height portions of the abrasive grains 60. When such abrasive grains 60 are applied to a grinding stone, by arranging the heights of the abrasive grains 60 according to the smallest heights of the abrasive grains 60, the projecting quantities of the abrasive grains 60 can be arranged. This can reduce the cutting quantities of the abrasive grains 60.

Here, although description has been given above with reference to an example in which the abrasive grains 60 have a truncated octahedron shape, even when the abrasive grains 60 have other polyhedral shape than the truncated octahedron shape, the classification can be controlled according to the smallest heights of the abrasive grains.

A further embodiment of the abrasive grains classifying apparatus is described with reference to FIG. 6.

Figure 6:
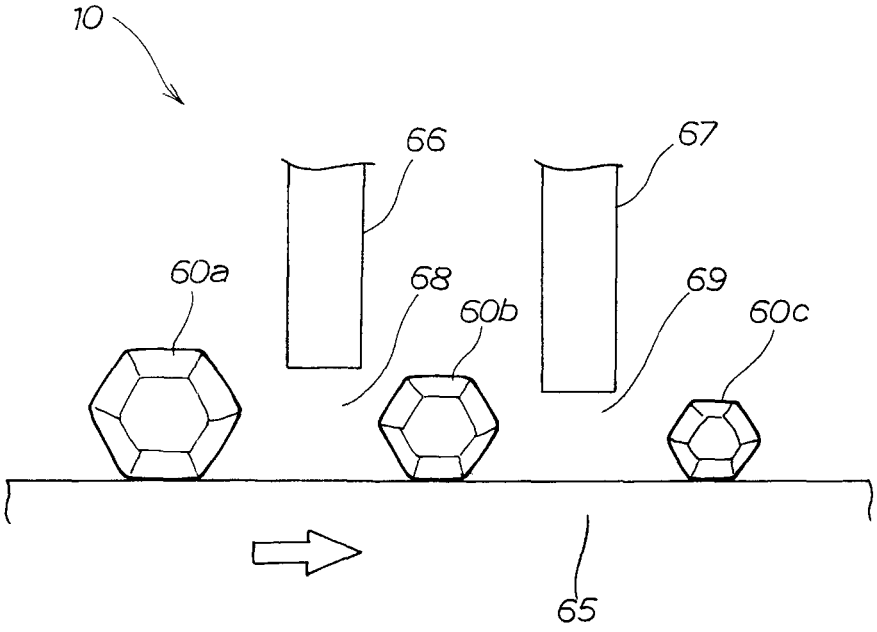
FIG. 6 is an explanatory view of an operation of a further embodiment of the abrasive grains classifying apparatus.

As shown in FIG. 6, upwardly of a rigid body 65 such as a conveyor which can be operated in such a manner as shown by a white arrow, there can also be disposed two rigid bodies 66 and 67. In this case, a gap portion, which is formed between the rigid bodies 65 and 66, is a first gap portion 68; and, a gap portion, which is formed between the rigid bodies 65 and 67 in such a manner that it is narrower than the first gap portion 68, is a second gap portion 69.

In this structure as well, there can be obtained the effect of the invention that the sizes of the abrasive grains 60 can be controlled with high accuracy.

A still further embodiment of the abrasive grains classifying apparatus of the invention is described with reference to FIG. 7.

Figure 7:
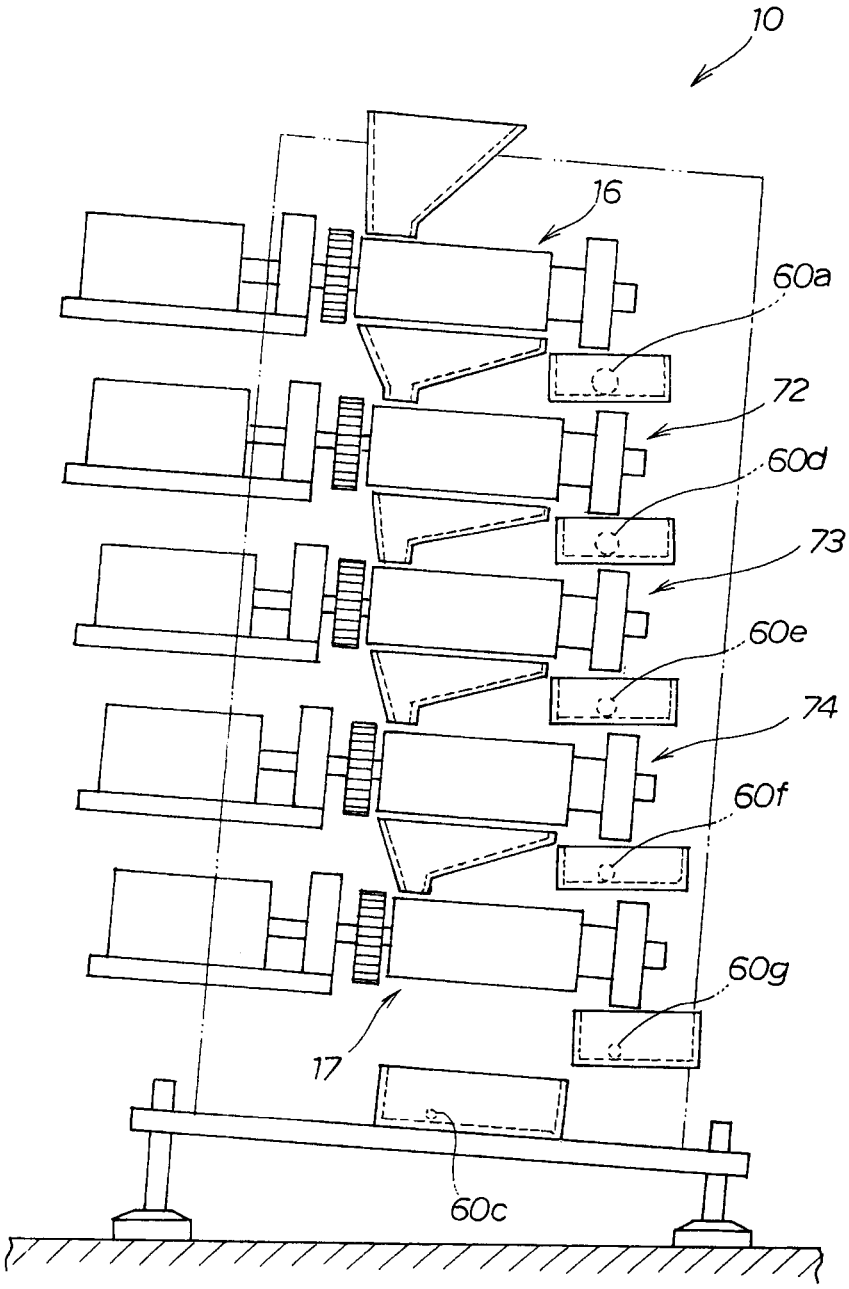
FIG. 7 is an explanatory view of an operation of a still further embodiment of the abrasive grains classifying apparatus.

As shown in FIG. 7, between the first classifying mechanism 16 for removing abrasive grains larger than a predetermined size and the second classifying mechanism 17 for removing abrasive grains smaller than a predetermined size, there are interposed a third classifying mechanism 72, a fourth classifying mechanism 73 and a fifth classifying mechanism 74.

Owing to this structure, the abrasive grains 60 can be classified to abrasive grains 60*d* to 60*g* that have not passed through the second classifying mechanism 17 to the fifth classifying mechanisms 74.

Also, in this case as well, there can be obtained the effect of the invention that the sizes of the abrasive grains 60 can be controlled with high accuracy.

The electrolytic deposition of the abrasive grains is described with reference to FIGS. 8A to 9C.

Figure 8A:
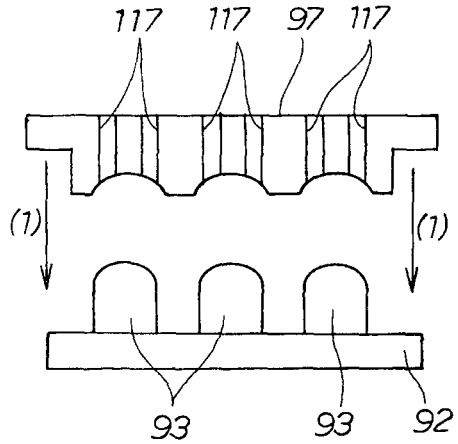
FIGS. 8A to 8C are explanatory views of a placing step to a vibrating step.

As shown by arrow lines (1) in FIG. 8A, a template 97 is moved down toward upwardly of a base material 93. In this case, the template 97 is lowered in such a manner that there exists a slight gap between the base material 93 and template 97. The reason for this will be given later.

Figure 8B:
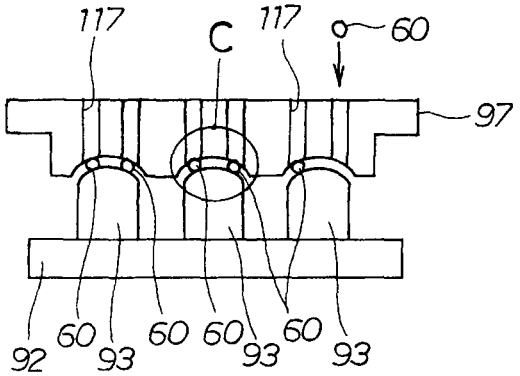

Next, as shown in FIG. 8B, the abrasive grains 60 are placed on the upper surface of the base material 93 through guide holes 117.

The placement of the abrasive grains 60 may be carried out by passing the abrasive grains 60 through the guide holes 117 formed in the template 97. Owing to this, the abrasive grains 60 can be placed at proper positions quickly. This makes it possible to carry out a grinding stone manufacturing operation in a short time.

Also, the placement step is carried out in a state where the base material 93, which has previously received an oxide film removing treatment, is immersed in an electrolytic deposition solution. Here, there is known a method in which, after the abrasive grains are placed outside an electrolytic deposition bath, the base material is delivered to the electrolytic deposition bath and is then immersed into the electrolytic deposition solution. However, this method has a problem that, in the base material delivering and immersing steps, the abrasive grains can slide or roll. On the other hand, when the placement of the abrasive grains 60 is carried out in the electrolytic deposition solution, this problem can be solved; and also, in the grinding stone manufacturing process, the oxidation of the base material can be prevented, which makes it possible to prevent the sticking strength of the abrasive grains 60 from lowering.

Figure 8C:
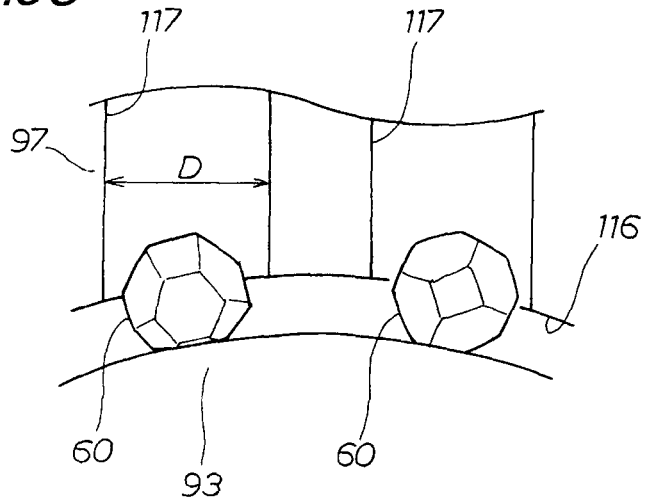

In this case, as shown in FIG. 8C which is the enlarged view of the c portion shown in FIG. 8B, there exist an abrasive grain like an abrasive grain 60 shown on the left the hexagonal surface of which is in contact with the base material 93, and an abrasive grain like an abrasive grain 60 shown on the right the square surface of which is in contact with the base material 93. Vibrations are given to the thus placed abrasive grains 60. The vibrations are given by a vibration generator which is connected to the template 97 or base material 93.

When the vibrations are given, since the diameter D of the guide hole 117 is larger than the abrasive grains 60, the abrasive grains 60 are caused to roll due to such vibrations. When rolling, most of the abrasive grains 60 are contacted with the base material 93 in the relatively wider surfaces thereof in such a manner that the heights of the abrasive grains 60 become the smallest.

That is, to bring the wider surfaces of the abrasive grains 60 into contact with the base material 93 can minimize the projecting quantities of the abrasive grains 60 from the base material 93. The projecting heights of the abrasive grains 60 can be arranged at the smallest heights of the abrasive grains 60 and, when arranging the heights, the cutting quantities of the abrasive grains 60 can be reduced.

In abrasive grains 60 which have a polyhedron shape, the distances between the mutually opposed surfaces thereof can vary. To bring the wider surfaces of the abrasive grains 60 into contact with the base material 93 can minimize the protecting quantities thereof from the base material 93. The projecting heights of the abrasive grains 60 can be arranged at the smallest heights of the abrasive grains 60 and, when arranging the heights, the cutting quantities of the abrasive grains 60 can be reduced.

Figure 9A:
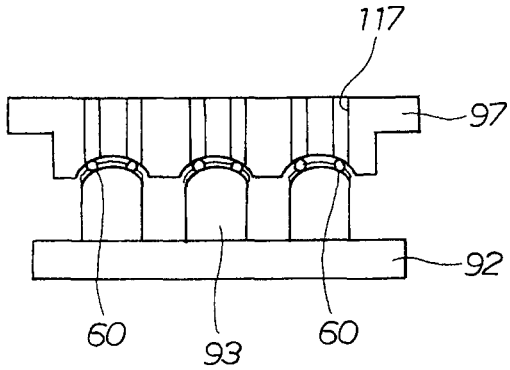
FIGS. 9A and 9B are explanatory views of an electrolytic deposition step.

As shown in FIG. 9A, after the abrasive grains 60 are arranged at the smallest heights, there is carried out a provisional electrolytic deposition operation. In this case, the electrolytic deposition operation is executed in a state where the template 97 is left disposed in order to prevent the abrasive grains 60 from dropping down from the base material 93. When the template 97 is closely contacted with the base material 93 in the provisional electrolytic deposition, the abrasive grains 60 cannot be electrolytic deposited on the base material 63. In view of this, the template 97 is disposed in such a manner that there is a slight gap between the template 97 and base material 93.

Figure 9B:
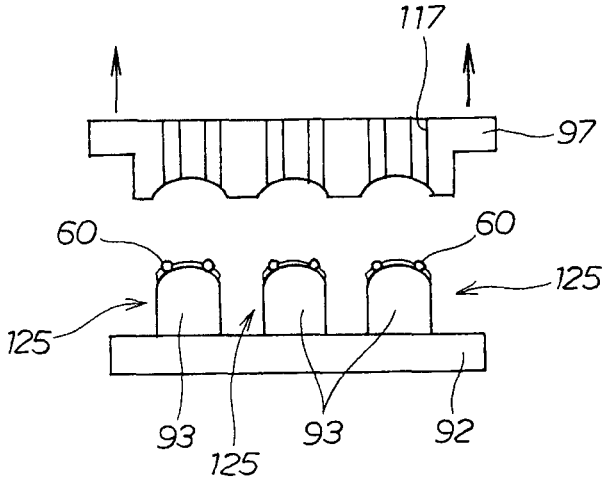

Next, as shown in FIG. 9B, when a second lift mechanism (not shown) is driven to raise the template 97, the template 97 is retreated and then there is carried out a main electrolytic deposition operation.

In this manner, a grinding stone 125 is completed.

The contents of FIGS. 9A and 9B can be summed up in the following manner.

That is, in the electrolytic deposition step, after execution of the provisional electrolytic deposition step, the template 97 is retreated and the main electrolytic deposition step is carried out. In the provisional electrolytic deposition step, the abrasive grains 60 are prevented against shifting and, in the main provisional electrolytic deposition step in which the template 97 is retreated, the abrasive grains 60 are fixed. This can increase the sticking strength of the abrasive grains 60, thereby being able to extend the life of the grinding stone.

The grinding stone manufactured in this manner is described with reference to FIG. 10.

Figure 10:
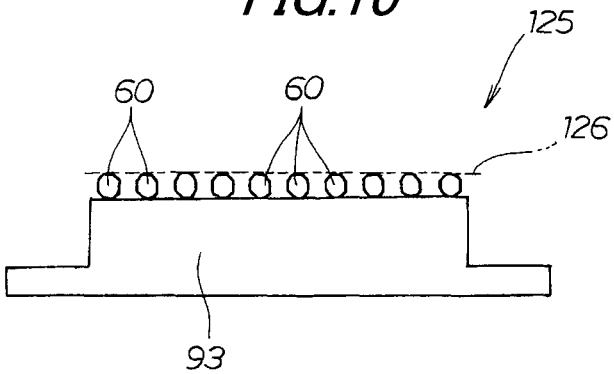
FIG. 10 is an explanation view of a grinding stone.

As shown in FIG. 10, the abrasive grains 60 are sticking to the surface of the base material 93. Since the abrasive grains 60 are allowed to stick to the surface having a wider area, the projecting quantities of the abrasive grains 60 from the base material 93 can be made the smallest. The projecting heights of the abrasive grains from the base material can be arranged at the smallest heights of the abrasive grains, whereby, when arranging the heights of the abrasive grains, the cutting quantities of the abrasive grains can be reduced.

That is, the abrasive grains 60 are disposed such that the smallest distance between the surfaces can provide the projecting heights of the abrasive grains from the base material 93. This can arrange the heights of the abrasive grains 60 in such a manner as shown by a line 126. That is, one of the surfaces providing the smallest distance of the respective abrasive grains 60 is stuck to the base material 93. Owing to this, the projecting heights of the abrasive grains from the base material 93 can be arranged at the smallest heights of the abrasive grains 60 and thus, when arranging the heights of the abrasive grains, the cutting quantities of the abrasive grains can be reduced.

Now, the grinding stone manufactured using the abrasive grains classified in FIG. 7 will be described with reference to FIG. 11.

Figure 11:
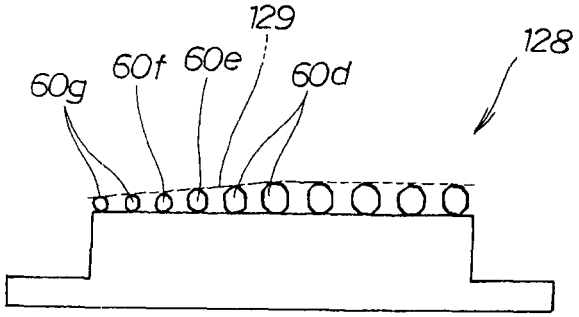
FIG. 11 is an explanation view of a further embodiment of the grinding stone.
Figure 12A:
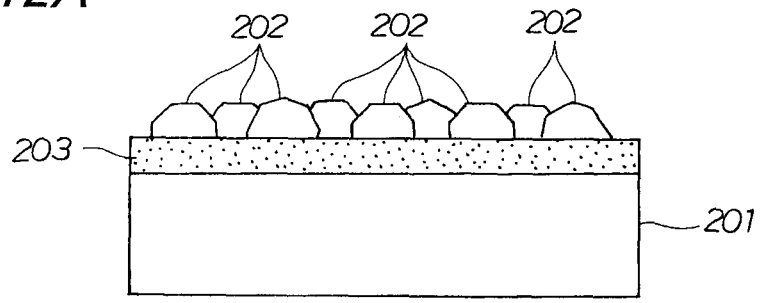
FIGS. 12A and 12B are explanatory views of a basic structure according to a prior art technology.
Figure 12B:
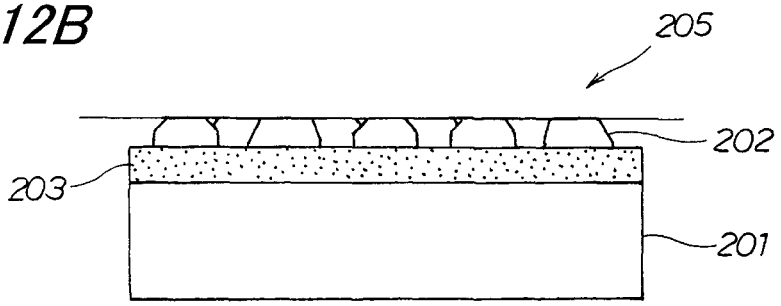

As shown in FIG. 11, in the grinding stone 128, the abrasive grains 60*d* to 60*g* classified into plural sizes are disposed on the base material sequentially in the size increasing order. Specifically, the abrasive grains are disposed sequentially in the order starting from the smallest abrasive grains 60*g* and ending at the large abrasive grains 60*d*. In this case, as shown by a line 129, the abrasive grains 60 are disposed in such a manner that the leading ends of the abrasive grains 60 are tapered. When it is necessary to cut the abrasive grains 60 in a tapered manner, by previously disposing the abrasive grains 60 in such a manner that the leading ends of the abrasive grains 60 are tapered, the cutting quantities of the abrasive gains 60 can be reduced.

Here, although the abrasive grains according to the invention have been described heretofore with reference to an example in which they respectively have a truncated octahedron shape, they may also have any one of other polyhedron shapes.

While description has been made in connection with specific exemplary embodiment and specific further embodiments of the invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

10: Abrasive grain classifying apparatus
22: First actuator
24, 32: First roller (rigid body)
35, 68: First gap portion
46: Second actuator
48, 49: Second roller (rigid body)
54, 69: Second gap portion
60: Abrasive grains
61: Horizontal axis

What is claimed is:

1. An abrasive grains classifying apparatus, for classifying abrasive grains based on sizes of the abrasive grains, each of the abrasive grains having polyhedral shape in which mutually opposed surfaces are parallel to each other, the size of the each of the abrasive grains being determined by distances between said mutually opposed surfaces, the apparatus comprising:

a first gap portion including two first rigid bodies disposed at a first predetermined distance from each other to supply the abrasive grains between the two first rigid bodies and classify the abrasive grains into first abrasive grains capable of passing between the two first rigid bodies and second abrasive grains incapable of passing between the two first rigid bodies; and a second gap portion including two second rigid bodies disposed at a second predetermined distance smaller than said first predetermined distance from each other to supply said first abrasive grains having passed through said first gap portion between the two second rigid bodies and classify said first abrasive grains into third abrasive grains capable of passing between the two second rigid bodies and fourth abrasive grains incapable of passing between the two second rigid bodies, wherein the two first rigid bodies comprise first rollers rotated by a first actuator and the two second rigid bodies comprise second rollers rotated by a second actuator, the first rollers and the second rollers are rotated by the first actuator and the second actuator independently from each other, the apparatus further comprises a first drive gear disposed between the first actuator and one roller of the first rollers and a first driven gear on the other roller of the first rollers engaged with the first drive gear, the other roller of the first rollers is rotated by the first actuator through the first drive gear and the first driven gear, the apparatus further comprises a second drive gear disposed between the second actuator and one roller of the second rollers and a second driven gear on the other roller of the second rollers engaged with the second drive gear, the other roller of the second rollers is rotated by the second actuator through the second drive gear and the second driven gear, and the first rollers and the second rollers are independently rotated by the first and second actuator in a direction to raise the abrasive grains.

2. The abrasive grains classifying apparatus according to claim 1, wherein the first and second rollers are respectively arranged to incline with respect to a horizontal axis.

3. The abrasive grains classifying apparatus according to claim 1, wherein the first rollers are rotated by the first actuator toward a direction for raising the abrasive grains, and the second rollers are rotated by the second actuator toward a direction for raising the abrasive grains.

4. The abrasive grains classifying apparatus according to claim 1, wherein a left side roller of the first rollers rotates in a counterclockwise direction and a right side roller of the first rollers rotates in a clockwise direction, when the first rollers are viewed in an axial direction of the first rollers, and wherein a left side roller of the second rollers rotates in a counterclockwise direction and a right side roller of the second rollers rotates in a clockwise direction, when the second rollers are viewed in an axial direction of the second rollers.

5. The abrasive grains classifying apparatus according to claim 2, wherein the apparatus further comprises a first hopper above the first gap portion and a second hopper above the second gap portion, each having an upper inlet and a lower outlet, the lower outlet of the first hopper is disposed above an upstream end of the first gap portion, and the upper inlet of the second hopper is disposed below the first gap portion so that the second hopper covers an entire length of the first gap portion.

6. The abrasive grains classifying apparatus according to claim 5, wherein a length of the upper inlet of the second hopper in a direction parallel to the first gap portion is about the same length as the longitudinal length of the first gap portion so that the second hopper can catch abrasive grains from any part of the first gap portion.

7. The abrasive grains classifying apparatus according to claim 1, wherein the apparatus further comprises a third gap portion between the first gap portion and the second gap portion, the third gap portion comprising two third rigid bodies comprising third rollers disposed at a third predetermined distance from each other to supply the abrasive grains between the two third rigid bodies and classify the abrasive grains into fifth abrasive grains capable of passing through the third gap portion and sixth abrasive grains incapable of passing through the third gap portion.

8. The abrasive grains classifying apparatus according to claim 1, wherein the apparatus further comprises one or more gap portions between the first gap portion and the second gap portion, each of the gap portions comprising two rigid bodies comprising rollers disposed at a predetermined distance from each other to supply the abrasive grains between the two rigid bodies and classify the abrasive grains into abrasive grains capable of passing through the gap portion and abrasive grains incapable of passing through the gap portion, and wherein the predetermined distances of the one or more gap portions further classify the first abrasive grains to abrasive grains with sizes smaller than the size of the first abrasive grains and larger than the size of third abrasive grains.

9. The abrasive grains classifying apparatus according to claim 8, wherein the one or more gap portions are disposed at regular intervals between the first and second gap portions.

10. The abrasive grains classifying apparatus according to claim 8, wherein the apparatus further comprises a first hopper above the first gap portion and a second hopper above the second gap portion, each having an upper inlet and a lower outlet, and the lower outlet of the first hopper being disposed above an upstream end of the first gap portion;

each of one or more gap portions has a hopper having an upper inlet and a lower outlet above the gap portion, the lower outlet of the hopper being disposed above an upstream end of the gap portion; and a length of the upper inlet of hopper of each of the one or more gap portions in a direction parallel to the gap portion disposed above the hopper is about the same length as the longitudinal length of the gap portion disposed above the hopper so that the hopper can catch abrasive grains from any part of the gap portion disposed above the hopper.

11. An abrasive grains classifying apparatus, comprising:

a first gap portion having a first predetermined distance comprising two first rollers rotated by a first actuator, the first gap portion classifying the abrasive grains into first abrasive grains capable of passing through the first gap portion and second abrasive grains incapable of passing through the first gap portion;

a second gap portion having a second predetermined distance comprising two second rollers rotated by a second actuator; the second gap portion classifying the first abrasive grains into third abrasive grains capable of passing through the second gap portion and fourth abrasive grains incapable of passing through the second gap portion, the first rollers and the second rollers are rotated by the first actuator and the second actuator independently from each other, the first and second gap portions being arranged to incline with respect to a horizontal line; and a first hopper above the first gap portion and a second hopper above the second gap portion, each hopper having an upper inlet and a lower outlet, each hopper having abrasive grains having a polyhedral shape in which mutually opposed surfaces are parallel to each other, wherein the lower outlet of the first hopper is disposed above an upstream end of the first gap portion, and a length of the upper inlet of the second hopper in a direction parallel to the first gap portion is about the same length as the longitudinal length of the first gap portion so that the second hopper can catch the first abrasive grains from any part of the first gap portion, wherein the apparatus further comprises a first drive gear disposed between the first actuator and one roller of the first rollers and a first driven gear on the other roller of the first rollers engaged with the first drive gear, the other roller of the first rollers is rotated by the first actuator through the first drive gear and the first driven gear, the apparatus further comprises a second drive gear disposed between the second actuator and one roller of the second rollers and a second driven gear on the other roller of the second rollers engaged with the second drive gear, the other roller of the second rollers is rotated by the second actuator through the second drive gear and the second driven gear, and the first rollers and the second rollers are independently rotated by the first and second actuator in a direction to raise the abrasive grains.

12. The abrasive grains classifying apparatus according to claim 11, wherein the apparatus further comprises one or more gap portions between the first gap portion and the second gap portion, each of the gap portions comprising two rollers disposed at a predetermined distance from each other classifying the abrasive grains into abrasive grains capable of passing through the gap portion and abrasive grains incapable of passing through the gap portion;

the predetermined distances of the one or more gap portions further classify the first abrasive grains to abrasive grains with sizes smaller than the size of the first abrasive grains and larger than the size of third abrasive grains;

each of one or more gap portions has a hopper having an upper inlet and a lower outlet above the gap portion, the lower outlet of the hopper being disposed above the upstream end of the gap portion disposed under the gap portion; and a length of the upper inlet of hopper of each of the one or more gap portions in a direction parallel to the gap portion disposed above the gap portion is about the same length as the longitudinal length of the gap portion disposed above the hopper so that the hopper can catch abrasive grains from any part of the gap portion disposed above the hopper.

* * * * *